United States Patent [19]

Redinger, Jr. et al.

[11] 4,019,320

[45] Apr. 26, 1977

[54] EXTERNAL GAS TURBINE ENGINE COOLING FOR CLEARANCE CONTROL

[75] Inventors: Ira H. Redinger, Jr., Vernon; David Sadowsky; Philip S. Stripinis, both of South Windsor, all of Conn.

[73] Assignee: United Technologies Corporation, Hartford, Conn.

[22] Filed: Dec. 5, 1975

[21] Appl. No.: 638,132

[52] U.S. Cl. ..... 60/226 R; 60/39.66; 60/266; 415/116; 415/138

[51] Int. Cl.[2] ..... F02C 7/18

[58] Field of Search ..... 60/39.66, 226 R, 262, 60/266; 415/12, 178, 180, 114–117, 127, 128

[56] References Cited

UNITED STATES PATENTS

| | | | |
|---|---|---|---|
| 2,811,833 | 11/1957 | Broffitt | 60/39.66 |
| 2,994,472 | 8/1961 | Botje | 415/178 |
| 3,141,651 | 7/1964 | Moyer | 415/136 |
| 3,295,823 | 1/1967 | Waugh et al. | 415/136 |
| 3,575,528 | 4/1971 | Beam et al. | 415/116 |
| 3,583,824 | 6/1971 | Smuland et al. | 415/134 |
| 3,742,705 | 7/1973 | Sifford | 415/116 |
| 3,864,056 | 2/1975 | Gabriel et al. | 415/136 |
| 3,869,222 | 3/1975 | Rahnke et al. | 415/138 |
| 3,966,354 | 6/1976 | Patterson | 415/116 |

FOREIGN PATENTS OR APPLICATIONS

| | | | |
|---|---|---|---|
| 695,482 | 8/1953 | United Kingdom | 60/262 |

*Primary Examiner*—Carlton R. Croyle
*Assistant Examiner*—Robert E. Garrett
*Attorney, Agent, or Firm*—Norman Friedland

[57] ABSTRACT

A reduction of the opening of the clearance between the outer air seal secured to the case of a turbo-fan engine and the tip of the turbine buckets is obtained ky selectively turning on and off or modulating the cool air supply. The cool air is bled from the fan discharge duct and is directed externally of the engine case adjacent the seal. Circumferentially mounted spray bars are axially spaced to fit juxtaposed to the annular flanges extending from the engine case and carry a plurality of holes judiciously located to direct the flow of cool air to impinge on the side walls of the flanges to effectuate shrinkage of the case.

8 Claims, 4 Drawing Figures

EXTERNAL GAS TURBINE ENGINE COOLING FOR CLEARANCE CONTROL

BACKGROUND OF THE INVENTION

This invention relates to gas turbine engines and particularly to means for controlling the clearance between the turbine outer air seal and the tip of the turbine rotor.

It is well known that the clearance between the tip of the turbine and the outer air seal is of great concern because any leakage of turbine air represents a loss of turbine efficiency and this loss can be directly assessed in loss of fuel consumption. Ideally, this clearance should be maintained at zero with no attendant turbine air leakage or loss of turbine efficiency. However, because of the hostile environment at this station of the gas turbine engine such a feat is practically impossible and the art has seen many attempts to optimize this clearance so as to keep the gap as close to zero as possible.

Although there has been external cooling of the engine case, such cooling heretofore has been by indiscriminately flowing air over the casing during the entire engine operation. To take advantage of this air cooling means, the engine case would typically be modified to include cooling fins to obtain sufficient heat transfer. This type of cooling presents no problem in certain fan jet engines where the fan air is discharged downstream of the turbine, since this is only a matter of proper routing of the fan discharge air. In other installations, the fan discharge air is remote from the turbine case and other means would be necessary to achieve gap control and this typically has been done by way of internal cooling.

Even more importantly, the heretofore system noted above that call for indiscriminate cooling do not maximize gap control because it fails to give a different clearance operating line at below the maximum power engine condition (Take-off). This can best be understood by realizing that minimum clearance occurs for maximum power since this is when the engine is running hottest and at maximum rotational speed. Because the casing is being cooled at this regime of operation the case is already in the shrunk or partially shrunk condition so that when the turbine is operating at a lower temperature and or lower speed the case and turbine will tend to contract back to their normal dimension. Looking at FIG. 2, this is demonstrated by the graph which is a plot of compressor speed and clearance.

It is apparent from viewing the graph that point A on line B is the minimum clearance and any point below will result in contact of the turbine and seal. Obviously, this is the point of greatest growth due to centrifugal and thermal forces, which is at the aircraft take-off condition at sea level. Hence, the engine is designed such that the minimum clearance will occur at take-off. Without implementing cooling, the parts will contract in a manner represented by line B such that the gap will increase as the engine's environment becomes less hostile. Curve C represents the gap when cooling is utilized.

It is apparent that since line C will result in a closure of the gap and rubbing of the turbine and seal as it approaches the sea level take-off operating regime, the engine must be designed so that this won't happen. Hence, with indiscriminate cooling, as described, line C would have to be moved upwardly so that it passes through point A at the most hostile operating condition. Obviously, when this is done operating of the engine will essentially provide a larger gap at the less hostile engine operating conditions.

We have found that we can obviate the problem noted above and minimize turbine air losses by optimizing the thermal control. This is accomplished by turning the flow of cool air on and off at a certain engine operating condition below the take-off regime. Preferably, maximum cruise would be the best point at which to turn on the cooling air. The results of this concept can be visualized by again referring to the graph of FIG. 2. As noted the minimum clearance is designed for take-off condition as represented by point A on curve B. The clearance will increase along curve B as the engine power is reduced. When at substantially maximum cruise, the cooling air will be turned to the on condition resulting in a shrinkage of the engine case represented by curve D. When full cooling is achieved, further reduction in engine power will result in additional contraction of the turbine (due to lower heat and centrifugal growth) increasing the gap demonstrated by curve C.

The on-off control is desirable from a standpoint of simplicity of hardware. In installations where more sophistication and complexity can be tolerated the control can be a modulating type so that the flow of air can be modulated between full on and off to achieve a discreet thermal control resulting in a growth pattern that would give a substantially constant clearance as represented by the dash line E.

This invention contemplates utilizing axially spaced spray bars designed to direct cooling flow bled from the fan discharge duct on the side walls of axially spaced flanges externally extending from the engine case adjacent the turbine station.

SUMMARY OF THE INVENTION

An object of this invention is to provide an improved means for controlling the gap between the tip of the turbine and the surrounding seal.

A still further object of this invention is to provide means for controlling cool air to flow to externally cool radially extending flanges projecting from the engine case. The cooled flanges shrink the case and the outer seal secured thereto is moved radially inward toward the tip of the turbine.

A still further object of this invention is to provide thermal control means for controlling the clearance of the outer air seal attached to the engine case to maintain given clearance by bleeding fan discharge air and through coincident means attached to spray bars to shrink the engine case by impinging the cool air on flanges extending externally of the engine case.

Other features and advantages will be apparent from the specification and claims and from the accompanying drawings which illustrate an embodiment of the invention.

DESCRIPTION OF THE PREFERRED EMBODIMENT

Figure 1:
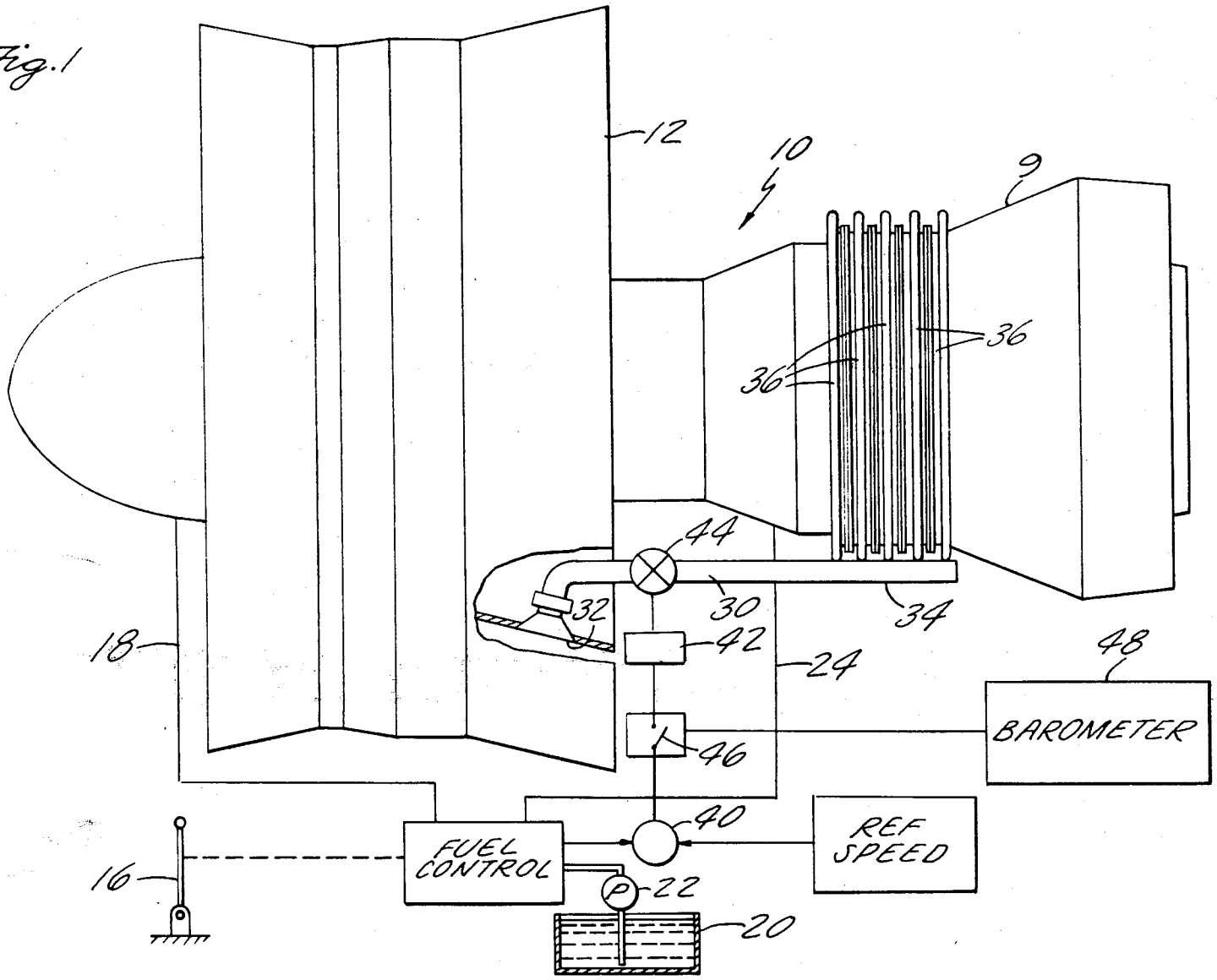
FIG. 1 is a view in elevation and schematic showing the invention connected to a turbofan engine.

Reference is made to FIG. 1 which schematically shows a fan-jet engine generally illustrated by reference numeral 10 of the axial flow type that includes a compressor section, combustion section and a turbine section (not shown) supported in engine case 9 and a bypass duct 12 surrounding the fan (not shown). A suitable turbo-fan engine, for example, would be the JT-9D manufactured by Pratt & Whitney Aircraft division of United Technologies Corporation and for further details reference should be made thereto.

Typically, the engine includes a fuel control schematically represented by reference numeral 14, which responds to monitored parameters, such as power lever 16 and compressor speed represented by line 18 and by virtue of its computer section computes these parameters so as to deliver the required amount of fuel to assure optimum engine performance. Hence, fuel from the fuel tank 20 is pressurized by pump 22 and metered to the burner section via line 24. A suitable fuel control is, for example, the JFC-60 manufactured by the Hamilton Standard Division of United Technologies Corporation or the one disclosed in U.S. Pat. No. 2,822,666 granted on Feb. 11, 1958 to S. Best and assigned to the same assignee both of which are incorporated herein by reference.

Suffice it to say that the purpose of showing a fuel control is to emphasize the fact that it already senses compressor speed which is a parameter suitable for use in this embodiment. Hence, it would require little, if any modification to utilize this parameter as will be apparent from the description to follow. As mentioned above according to this invention cool air is directed to the engine case at the hot turbine section and this cool air is turned on/off as a function of a suitable parameter. To this end, the pipe 30 which includes a funnel shaped intake 32 extending into a side of the annular fan duct 12 directs static pressurized flow to the manifold section 34 which communicates with a plurality of axially spaced concentric tubes or spray bars 36 which surrounds or partially surrounds the engine case. Each tube has a plurality of openings for squirting cool air on the engine case.

It is apparent from the foregoing that the air bled from the fan duct and impinged on the engine case serves to reduce its temperature. Since the outer air seal is attached to the case, the reduction in thermal growth of the case effectively shrinks the outer air seal and reduces the air seal clearance. In the typical outer air seal design, the seal elements are segmented around the periphery of the turbine and the force imparted by the casing owing to the lower temperature concentrically reduces the seals diameter. Obviously, the amount of clearance reduction is dictated by the amount of air impinged on the engine case.

Figure 2:
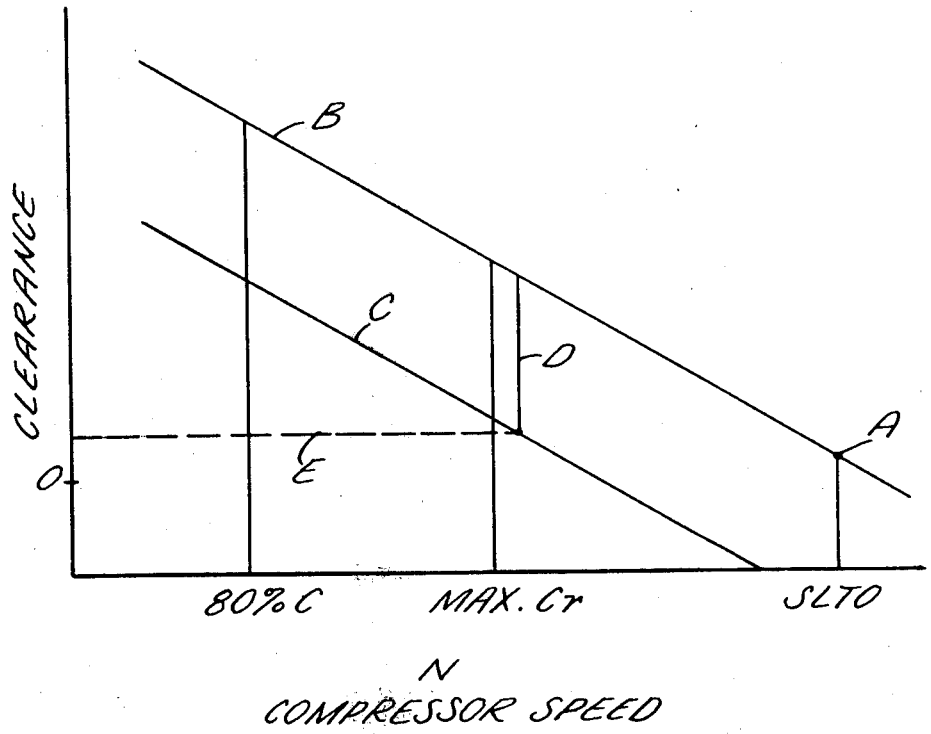
FIG. 2 is a graphical representation of clearance plotted against aircraft performance which can be predicated as a function of compressor speed.

To merely spray air on the engine case during the entire aircraft operation or power range of the surge would afford no improvement. The purpose of the cooling means is to reduce clearance at cruise or below maximum power. The way of accomplishing the reduction of clearance at cruise is to reduce the normal differential engine case to rotor thermal growth at cruise relative to take-off (maximum power). This again is illustrated by FIG. 2 showing the shift from curve B to C or E along line D. Hence the manner of obtaining the reduction of clearance at cruise is to turn on the air flow at this point of operation. If the flow is modulated so that higher flows are introduced as the power decreases, a clearance which will be substantially constant, represented by dash line E will result. If the control is an on/off type the clearance represented by curve C will result. While the on/off or modulating type of cool air control means may operate as a function of the gap between the outer air seal and tip of the turbine, such a control would be highly sophisticated and introduce complexity.

A viable parameter indicative of the power level or aircraft operating condition where it is desirable to turn on and off the cooling means is utilized. The selection of the parameter falling within this criteria will depend on the availability, the complexity, accuracy and reliability thereof. The point at which the control is turned on and off, obviously, will depend on the installation and the aircraft mission. Such a parameter that serves this purpose would be compressor speed (either low compressor or high compressor in a twin spool) or temperature along any of the engine's stations, i.e. from compressor inlet to the exhaust nozzle.

As schematically represented in FIG. 1 actual speed is manifested by the fuel control and a speed signal at or below a reference speed value noted at summer 40 will cause actuator 42 to open valve 44. A barometric switch 46 responding to the barometric 48 will disconnect the system below a predetermined attitude. This will eliminate turning on the system on the ground during low power operation when it is not needed, and could conceivably cause interference between the rotor tip and outer air seal when the engine is accelerated to sea level power.

Figure 3:
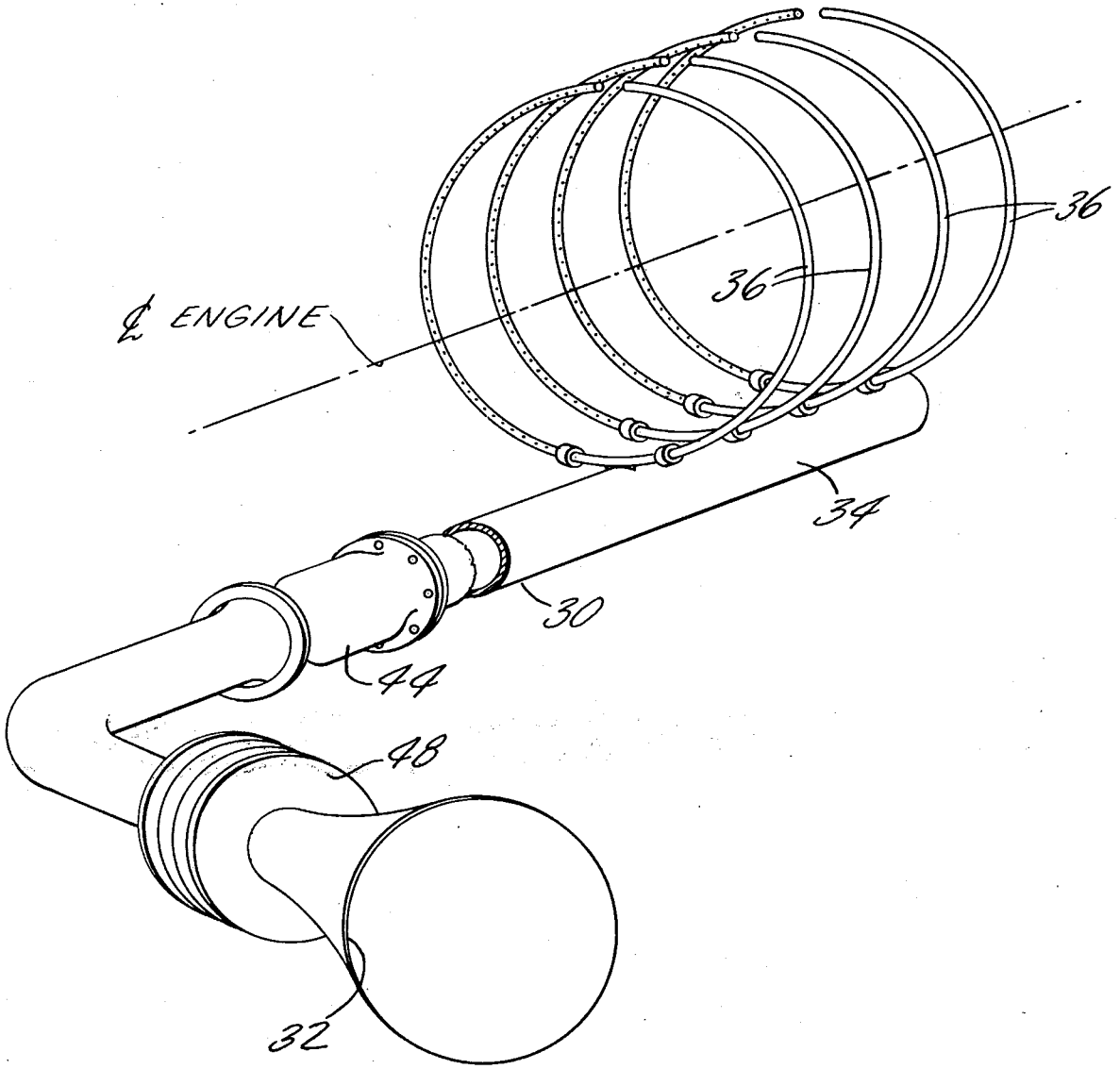
FIG. 3 is a perspective showing of one preferred embodiment.

FIG. 3 shows the details of the spray bars and its connection to the fan discharge duct. For ease of assembly a flexible bellows 48 is mounted between the funnel shaped inlet 32 and valve 44 which is suitably attached to the pipe 30 by attaching flanges. Each spray bar is connected to the manifold and is axially spaced a predetermined distance.

Figure 4:
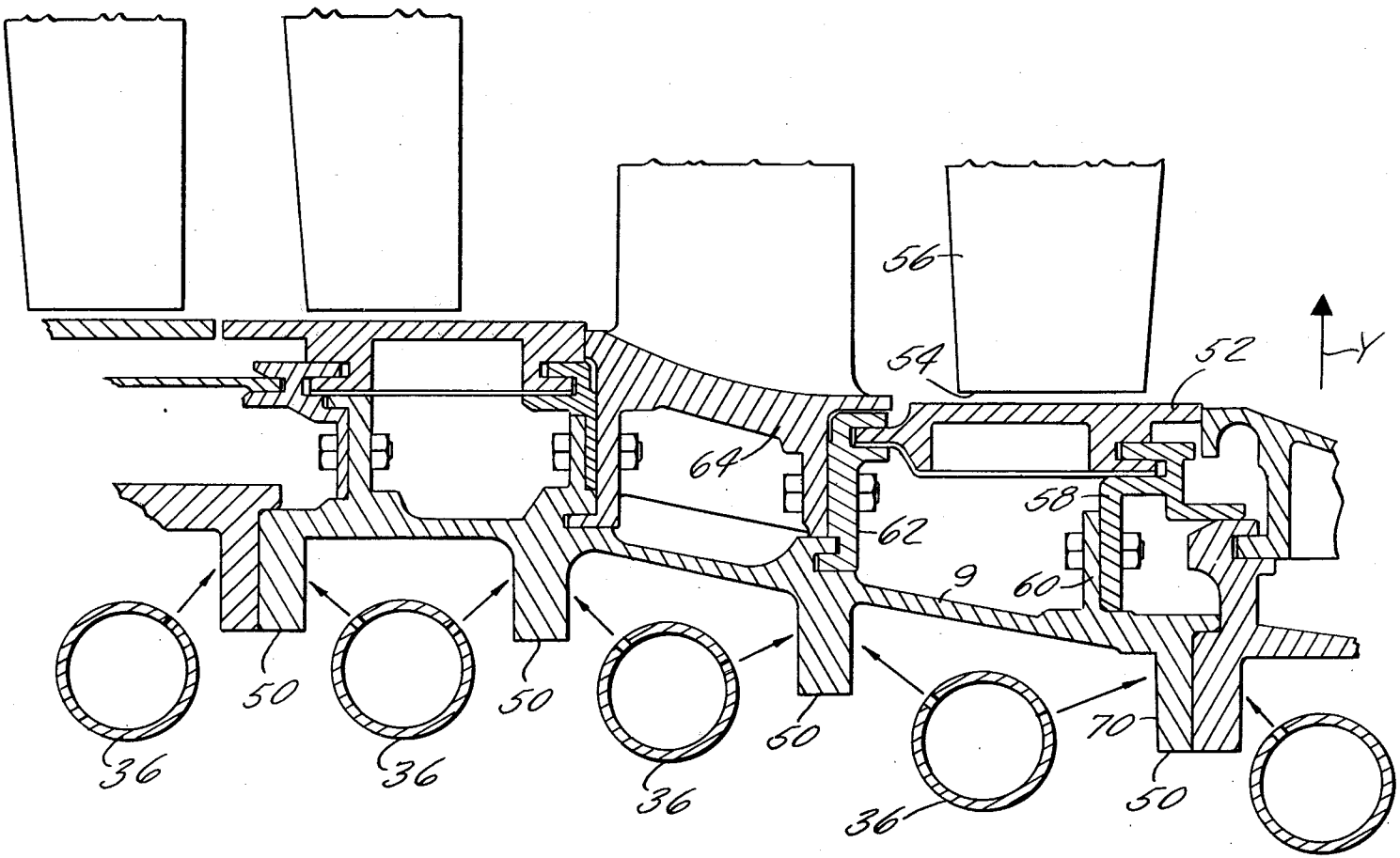
FIG. 4 is a partial view of a turbofan engine showing the details of the invention.

As can be seen from FIG. 4 each spray bar 36 fits between flanges 50 extending from the engine case. As is typical in jet engine designs the segmented outer air seal 52 is supported adjacent the tip of the turbine buckets by suitable support rings 58 bolted to depending arm 60 of the engine case and the support member 62 bolted to the fixed vane 64. Each seal is likewise supported and for the sake of convenience and simplicity a description of each is omitted herefrom. Obviously the number of seals will depend on the particular engine and the number of spray bars will correspond to that particular engine design and aircraft mission. Essentially, the purpose is to maintain the gap 54 at a value illustrated in FIG. 2.

To this end the apertures in each spray bar 36 is located so that the air is directed to impinge on the side walls 70 of flanges 50. To spray the casing 10 at any other location would not produce the required shrinkage to cause gap 54 to remain at the desired value. As noted from FIG. 4 flanges 50 are relatively thick compared to the casing wall. This assures that cooling would provide sufficient force to move the casing radially inward toward the tip of the turbine 56, i.e., in the direction of arrow Y.

It should be understood that the invention is not limited to the particular embodiment shown and described herein, but that various changes and modifications may be made without departing from the spirit or scope of this novel concept as defined by the following claims.

We claim:

1. For a turbofan engine operating over a range of power having a fan discharge duct, a turbine, a casing surrounding the turbine, and turbine seal means extending inwardly from said casing means for controlling the clearance between the tip of the turbine and the turbine seal means, said means including a plurality of axially spaced flanges extending outwardly from said casing, at least one tube circumferentially mounted about said engine case adjacent to said flanges, connection means interconnecting the fan discharge duct and said tube whereby the cool fan discharge air is directed to impinge on the side wall of said flange and said flange being sufficiently structured so that the effect of cooling causes the engine case to shrink to reduce the diameter of said air seal and the clearance between the turbine tip and said air seal and means for selectively turning the flow of air on and off at a given power condition of said range of power.

2. For a turbofan as claimed in claim 1 including wherein said last mentioned means includes valve means in said connection means.

3. For a turbofan engine as claimed in claim 2 wherein said means is responsive to an engine operating parameter.

4. For a turbofan engine as claimed in claim 3 wherein said engine operating parameter is compressor speed.

5. For a turbofan engine as in claim 1 wherein said connection means includes an inlet mounted in said fan discharge duct and being disposed transverse to the flow of fan air.

6. For a turbofan engine as claimed in claim 5 including a flexible bellows mounted in said connection means.

7. Means for controlling the thermal growth of a turbine case of a turbine type power plant operating over a range of power levels, having a turbine within said case, turbine seal means extending inwardly from said case, and having a fan and discharge duct, said means including an outer flange on said case extending radially outwardly and having a side wall, at least one spray bar at least partially surrounding said case adjacent said side wall, manifold means connected to said spray bar, connection means interconnecting said manifold means and said discharge duct for leading air from said discharge duct to impinge on the side walls of said flange, whereby said flange contracts for reducing the clearance adjacent the tip of the turbine.

8. Means as claimed in claim 7 including valve means in said connection means, and control means responsive to an engine operating parameter for controlling said valve means to open and close said valve at a predetermined value of said power levels.

* * * * *